US005257524A

United States Patent [19]

Jung

[11] Patent Number: 5,257,524

[45] Date of Patent: Nov. 2, 1993

[54] METHOD AND DEVICE FOR MANUFACTURING PIPE BENDS

[75] Inventor: Werner Jung, Jona, Switzerland

[73] Assignee: Rohrkalibrier - und Bogenautomaten Rokabo AG, Baar, Switzerland

[21] Appl. No.: 843,579

[22] Filed: Feb. 28, 1992

[30] Foreign Application Priority Data

Mar. 5, 1991 [DE] Fed. Rep. of Germany ..... 4106886

[51] Int. Cl.[5] ..... B21D 9/04; B21D 31/06; B21D 43/02

[52] U.S. Cl. ..... 72/370; 72/401; 72/402; 72/420

[58] Field of Search ..... 721/400–402, 721/420, 370, 393; 29/890.149

[56] References Cited

U.S. PATENT DOCUMENTS

| | | | |
|---|---|---|---|
| 1,010,733 | 12/1911 | Dieckmann | 72/401 |
| 3,494,170 | 2/1970 | Valleins | 72/401 |
| 4,178,790 | 12/1979 | Buckley et al. | 72/402 |
| 4,798,076 | 1/1989 | Rigsby et al. | 72/370 |

*Primary Examiner*—Lowell A. Larson
*Assistant Examiner*—Donald M. Gurley
*Attorney, Agent, or Firm*—Tarolli, Sundheim & Covell

[57] ABSTRACT

The method for manufacturing a pipe bend from a straight pipe piece by means of actuating members acting on the outside of the pipe piece and making an open shaping station, the diameter of the actuating members being expandable and compressible under the action of force, said method comprises the steps of: stepwise moving the pipe piece to and through the shaping station; grasping and pulling the pipe piece during its move to the shaping station by means a reciprocating member during the progressive motion of the reciprocating member; introducing the leading end of the pipe piece into the shaping station, supporting the pipe piece on its inside; upsetting and calibrating the pipe piece by compressing the actuating members of the shaping station while maintaining the supporting of the pipe piece on its inside; loosening the reciprocating member from the pipe piece; retaining the pipe piece in the shaping station during the retrograde motion of the reciprocating member; and repeating these steps until the pipe piece has completely passed the shaping station.

The method allows a very precise advance, which can be automated. As a result, the calibration quality is considerably improved.

25 Claims, 5 Drawing Sheets

METHOD AND DEVICE FOR MANUFACTURING PIPE BENDS

TECHNICAL FIELD

This invention relates to a method and a device for manufacturing a pipe bend from a straight pipe piece by means of actuating members acting o the outside of said pipe piece and, thereby, forming a shaping station.

BACKGROUND OF THE INVENTION

In a known device for manufacturing a pipe bend from a straight pipe piece having bevelled ends, this pipe bend is formed by the action of upsetting and calibrating forces onto the outer surface of said pipe piece. This device is provided with upsetting and calibrating segments which are jointly reciprocatingly movable under the action of a force and have each an upsetting and calibrating section. A slide is provided for guiding the pipe piece to be bent, said slide being reciprocatingly movable on a cant which is curved in agreement with the curvature of said pipe bend.

Such devices are practical and work reliably. However, they have the disadvantage that the problem of feeding and stepwise transporting the pipe piece to be worked is not satisfactorily solved. As it is known, the pipe piece to be worked lies on a loading rack and glides without control on a path, provided for this purpose, to the processing place, as soon as a light barrier releases the processing. Moreover, it is disadvantageous that the pipe piece to be worked is not supported on its inside during calibrating. This is most prejudical to the calibrating process.

OBJECTS OF THE INVENTION

It is the primary object of the present invention to provide a method for manufacturing a pipe bend from a straight pipe piece in which feeding and stepwise transporting the pipe piece to be worked is essentially improved.

It is a further object of the present invention to provide a device for carrying out this method allowing a reliable and simple working of the pipe piece, and also allowing automatization of the method by simple means.

SUMMARY OF THE INVENTION

To meet these and other objects, the present invention provides a method for manufacturing a pipe bend from a straight pipe piece by means of actuating members acting on the outside of said pipe piece and making an open shaping station, the diameter of said actuating members being expandable and compressible under the action of force, said method comprising the steps of:

stepwise moving said pipe piece to and through said shaping station;

grasping and pulling said pipe piece during its move to said shaping station by means of a reciprocating member during the progressive motion of said reciprocating member;

introducing the leading end of said pipe piece into said shaping station, supporting said pipe piece on its inside;

upsetting and calibrating said pipe piece by compressing said actuating members of said shaping station while maintaining said supporting of said pipe piece on its inside;

loosening said reciprocating member from said pipe piece;

retaining said pipe piece in said shaping station during the retrograde motion of said reciprocating member; and repeating these steps until said pipe piece has completely passed said shaping station.

The present invention further provides a device for manufacturing a pipe bend from a straight pipe piece, said device comprising:

an upsetting and calibrating unit making a shaping station, said upsetting and calibrating unit comprising upsetting and calibrating chops which are jointly radially movable under the action of force; and a reciprocating guiding and transporting device associated with said shaping station and extending into the same and comprising expandable and compressible grasping and supporting members for stepwise introducing said pipe piece into said shaping station and stepwise transporting it through the sam and for supporting its inside during the calibration process.

DESCRIPTION OF THE PREFERRED EMBODIMENTS

On principle, according to the invention, the pipe piece to be worked is freely taken to the open shaping station, is grasped there by expansion segments and transported into said shaping station. For this purpose, a transporting member is made to extend into said pipe piece to be worked, and is expanded there with respect to its perimeter to such extent that the corresponding parts abut against the inner wall of said pipe piece and that said pipe piece is carried into the working station. There, working is effected by up-setting and calibrating. Then, after the opening of the up-setting and calibrating chops, the pipe piece is separated from them, and the transporting member is pulled back. After another expansion of the transporting member, the pipe piece is grasped at a backward spot and stepwise moved forward by the subsequent movement of said transporting member.

In this way, the pipe piece is upsetted and calibrated after each forward step. Thereafter the transporting member is collapsed and pulled back. Moreover, during calibration, said transporting member serves as an inner support and secures the pipe piece.

Figure 1:
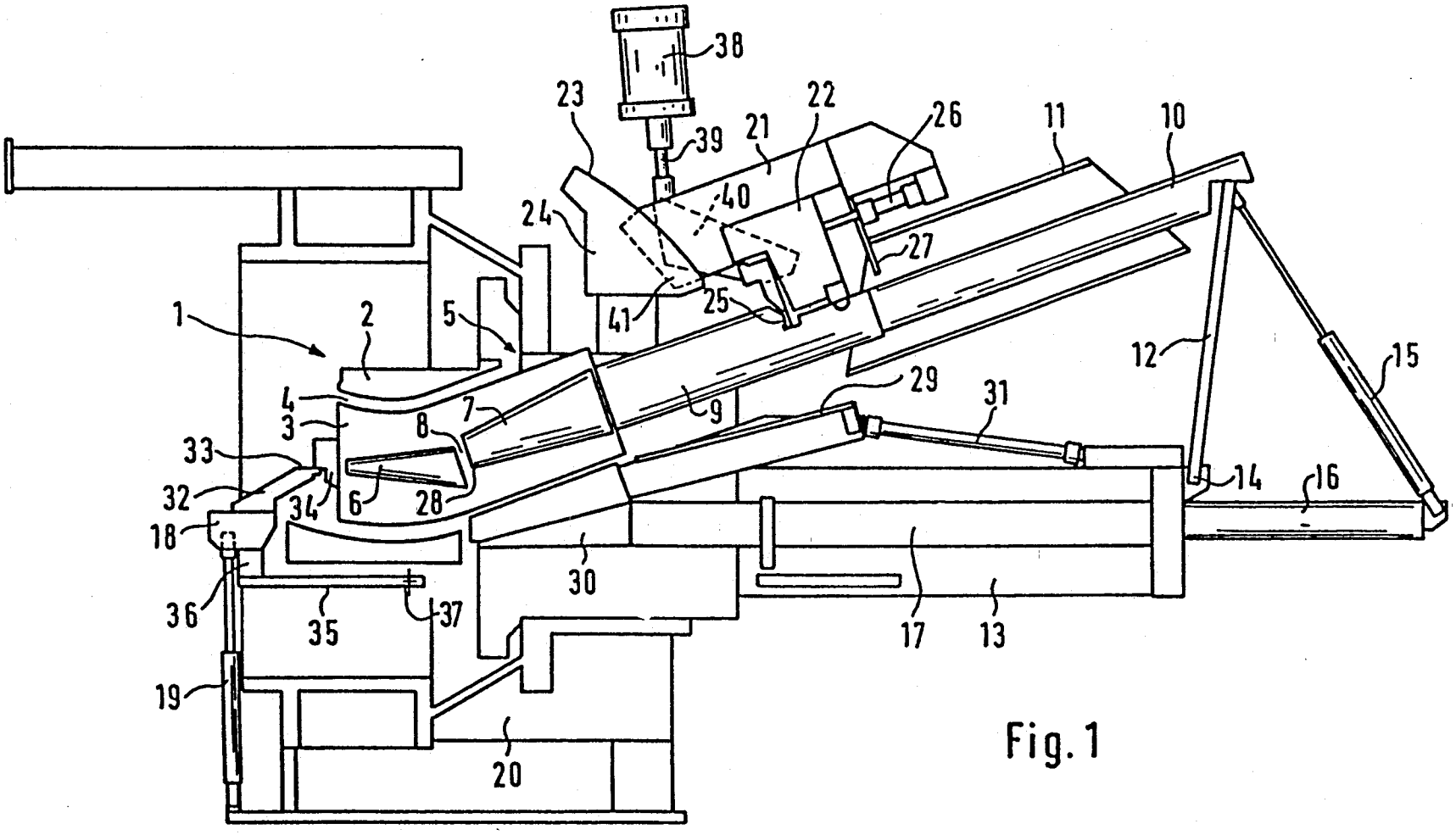
FIG. 1 is a schematic side view of a first embodiment of a device for manufacturing a pipe bend, in the starting position.

A first practical realization of this principle is shown in FIG. 1. The shaping station for upsetting and calibrating the pipe piece is marked 1. Such shaping stations are basically known, and comprise a plurality of movable up-setting and calibrating chops which are formed by segments. These segments are radially movable and arranged along a circle and secured to corresponding bearers. The segments are actuated by means of pairs of articulated levers which are able to exercise an upsetting and calibrating action.

Such an upsetting and calibrating device is described and shown in detail e.g. in German Patent Specification No. 29 43 960, so that a more detailed description is unnecessary.

Said segmented upsetting and calibrating chops, which are arranged along a circle, are marked 2. One end of a reciprocating guiding and transporting device 3 extends into the interspace 4 between the upsetting and calibrating chops 2. The outer surface of said reciprocating guiding and transporting device 3 approximately corresponds to the inner shape of the finished pipe bend, inasmuch that the end of said reciprocating guiding and transporting device 3, which for the rest is cylindrical, is curved in accordance with the pipe bend to be formed. The adjacent straight section of said reciprocating guiding and transporting device 3 runs out of the area of said shaping station 1 in a direction opposite to the conveying direction.

Likewise, the reciprocating guiding and transporting device 3 is at least partially composed of segments which are radially arranged side by side. The outer surface of said segments corresponds to the inner surface of said upsetting and calibrating chops 2. However, an interspace 4 is provided between said outer surface of the segments and said inner surface of the upsetting and calibrating chops 2 for taking up and working a pipe piece, as will described later.

Two cone-shaped bodies 6 and 7 are provided in the middle of the reciprocating guiding and transporting device 3 for expanding and compressing said segments of the reciprocating guiding and transporting device 3, said cone-shaped bodies 6 and 7 being reciprocatingly movable, thus making said segments expand and contract. These cone-shaped bodies 6 and 7 are articulatedly linked at 8 in order to be able to follow the curvature of the segments.

The reciprocating guiding an transporting device 3 is further linked to a hydraulic actuating device 9 comprising a hydraulic actuating member which, in the working direction, is superposed to said cone-shaped bodies 6 and 7. This hydraulic actuating member effects the reciprocating movement of both said cone-shaped bodies 6 and 7, thus controlling the segments of the reciprocating guiding and transporting device 3. Contraction and expansion of the segments can be effected e.g. by springs, and does not need to be shown in detail.

At the end which is averse from said reciprocating guiding and transporting device 3, the hydraulic actuating device 9 is fastened to a loading device 10 which has star-like rib guiding means (not shown) for taking up and guiding the pipe piece 11 to be worked.

In the position shown in FIG. 1, the unit which consists of said loading device 10, of said hydraulic actuating device 9 and of said reciprocating guiding and transporting device 3 does not run horizontally but has a slope towards the shaping station 1, thus making an inclined path for feeding the straight pipe piece 11 to said shaping station 1. This slope is produced by lifting the free end of the loading device 10 by means of a support 12. Said support 12 is swivelably secured to a basic frame 13 by means of a bearing 14, and is held in the scheduled position by a first piston-cylinder unit 15. This first piston-cylinder unit 15 is secured to the piston rod of a hydraulic unit 16 and 17, which is horizontally arranged and also serves the actuation of a key 30, as will described later with reference to FIGS. 4 and 5.

A path for guiding the pipe piece 11 from said loading device 10 farther, is provided by a guiding or supporting plate 29. The inclination of said path is adjusted by a second hydraulic unit 31. Thereafter, said path is supported by said key 30.

The reciprocating guiding and transporting device 3, and therewith the whole unit composed of items 3, 9 and 10 are supported at their lower end by means of a support 18 which is swivelably away, said support being mounted in a vertically adjustable manner on a third hydraulic unit 19. The support 18 which is swivelable away is provided with a supporting arm 32 comprising a supporting area 33 on which rests a holder 34 of said reciprocating guiding and transporting device 3, as shown in FIG. 1. The device also comprises a controlling arm 35 which at its one end is linked to a downwardly directed, extension 36 of said support 18 which is swivelable away, and at its other end is swivelably supported in a bearing 37 of the basic frame 20. This construction allows, by actuating a third hydraulic unit 19, to bring said supporting arm 32 from the position shown in FIG. 1 into the position shown in FIG. 3, in which the end of said reciprocating guiding and transporting device 3 is no longer supported.

In a similar manner, the support 12 can be swiveled away by means of said first piston-cylinder unit 15, as will be described later more in detail.

A suspension arrangement 21 is glideablely and swivelably arranged directly above said hydraulic actuating device 9 in the guiding cam 23 of a guiding piece 24. Said suspension arrangement 21 is provided with a holding unit 22 which is reciprocatingly movable with respect to said suspension arrangement 21 by means of an advance cylinder 26 and is provided with a swivelable hook 25. This hook 25 engages into a corresponding recess of the hydraulic actuating device 9, as shown in FIG. 1. For swivelably the suspension arrangement 21, a fourth piston-cylinder unit 38 is provided for which is preferably pneumatically actuated, and the piston rod 39 of which is linked to a control plate 40 which in turn is swivelably supported by the guiding piece 24 at 41.

The suspension arrangement 21 also comprises a stopper 27 which downwardly extends into the motion path of the pipe piece 11 and, in the position shown, prevents said pipe piece 11 from gliding farther.

Figure 2:
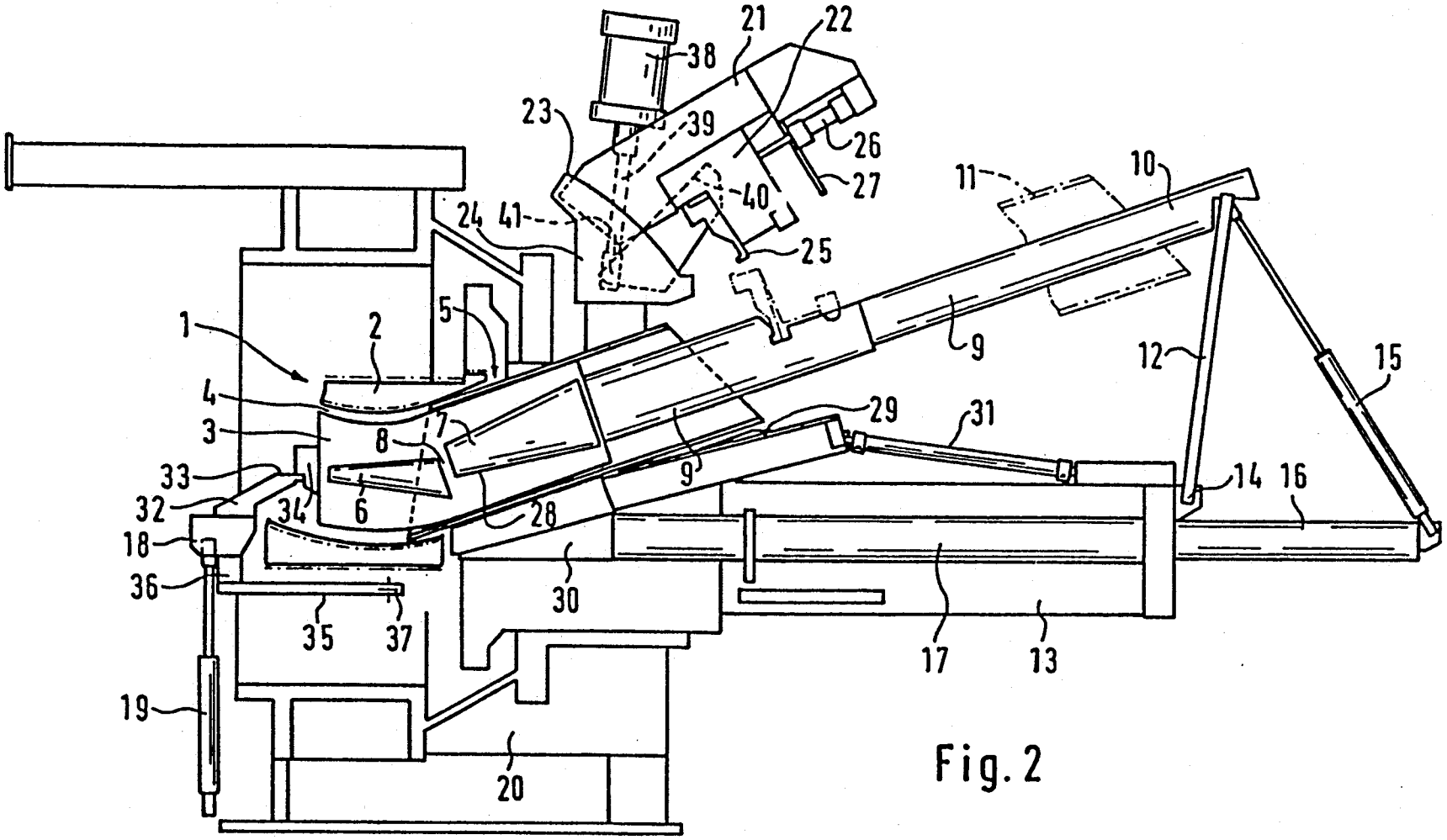
FIG. 2 shows the device of FIG. 1 in a first working position.

As shown in FIG. 2, the control plate 40 is anticlockwise swiveled by extension of the piston rod 39. Thereby, the suspension arrangement 21 moves along the guiding cam 23 into the position shown in FIG. 2, and the hook 25 is unhooked. The guiding cam 23 describes a sector of a circle having the center 28.

The stopper 27 is swiveled away from the motion path of the pipe piece 11 too, thus allowing the latter to glide farther downwardly. A guiding or supporting plate 29 may be provided for this purpose.

Figure 3:
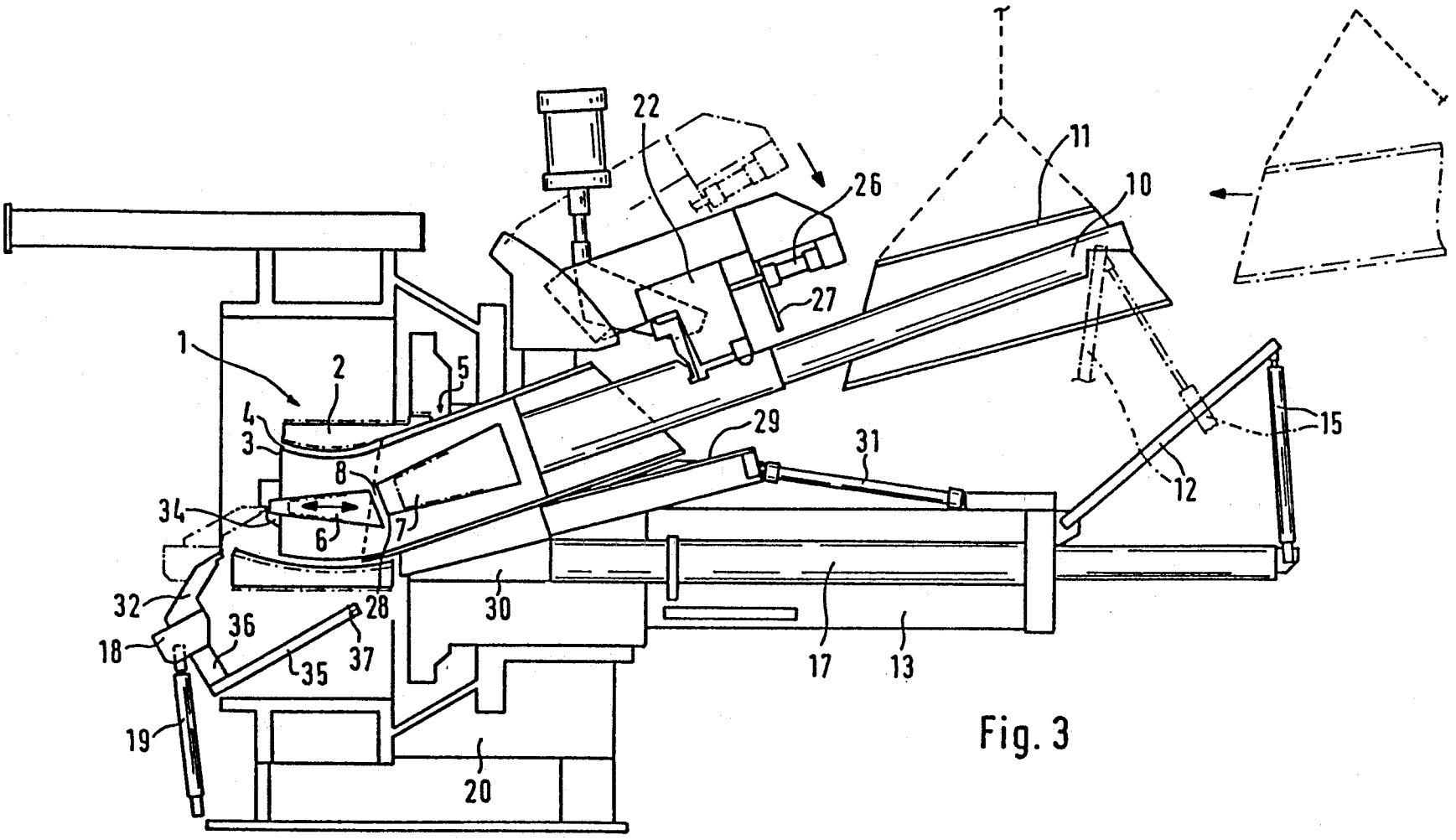
FIG. 3 shows the device of FIG. 1 in another working position.

The described device operates as follows:

In the starting position of the device both the supporting arm 32 and the support 12 are unhooked and swiveled away, as shown in FIG. 3. For this purpose, a third hydraulic unit 19 is used, which effects, by means of the controlling arm 35, a swiveling away of the supporting arm 32 together with the support 18 and the extension 36. By actuation of the first piston-cylinder unit 15, the support 12 is clockwise swiveled away. Now, the pipe piece 11 can freely be brought into the loading position, taking the position shown in FIG. 1. In this position, the pipe piece 11 is prevented from gliding farther by the stopper 27.

The guiding of the pipe piece 11 along the loading device 10 is effected by means of the guiding star mentioned above (not shown) which consists of ribs distributed on the periphery of the loading device 10 and extending in the longitudinal direction of the same. Thereafter, the front arm 32 and the support 12 are swiveled back into the position shown in FIG. 1. This is effected by actuation of the third hydraulic unit 19 and of the first piston-cylinder unit 15.

As soon as the shaping station 1 is free, i.e. after termination of the previous upsetting and calibrating process, the hook 25 is unhooked, and the hydraulic actuating device 9 is released. For effecting this, the fourth piston-cylinder unit 38 is actuated by ejecting its piston rod into the position shown in FIG. 2. In this manner, a swiveling of the swivelably pivoted control plate 40, which in turn provokes a dislocation of the suspension arrangement 21 along the guiding cam 23, is effected. Simultaneously, the stopper 27 secured to the suspension arrangement 21 is removed out of the motion path of the pipe piece 11, thus allowing the latter to move along the hydraulic actuating device 9 to the shaping station 1, where the upsetting and calibrating chops 2 are fully open.

The hydraulic actuating device 9 and a part of the reciprocating guiding and transporting device 3, the segments of which are contracted, extend through the pipe piece 11, so that said reciprocating guiding and transporting device 3 temporarily does not produce any effect, but only acts as a gliding guide for the pipe piece 11. The predetermined position of the pipe piece 11, in which it came to a standstill, is shown in FIG. 2.

Now, the suspension arrangement 21 is swiveled back, so that the hook 25 again grasps the hydraulic actuating device 9 and holds it in a suspended position before the front supporting arm 32 and the rear support 12 are swiveled away. In order to form the inner support of the front portion of the pipe piece 11, which portion is worked first, the segments of the reciprocating guiding and transporting device 3 are expanded. Thereafter, the first upsetting and calibrating step is effected by closing the upsetting and calibrating chops 2.

The next step is to draw the two cone-shaped bodies 6 and 7 back by means of the hydraulic actuating device 9. By this, the radially acting segments of the cone-shaped bodies 6 and 7 are loosened and reduced in diameter. However, simultaneously the end of the pipe piece 11 are locked by the upsetting and calibrating chops 2, while the hydraulic actuating device 9 is pulled back by the amount of the intended advance. Thereafter, the segments of the reciprocating guiding and transporting device 3, which also were pulled back, are expanded while in the pull-back position, and the upsetting and calibrating chops 2 are again opened. Now, another advance movement is effected, thereby moving the pipe piece 11 to be worked by the corresponding amount of advance into the upsetting and calibrating area. There, the next pipe section which is not yet calibrated is upsetted and calibrated as described above.

In this manner, the proceedings described above are repeated until the whole pipe piece 11 is finished to the rated size.

Figure 4:
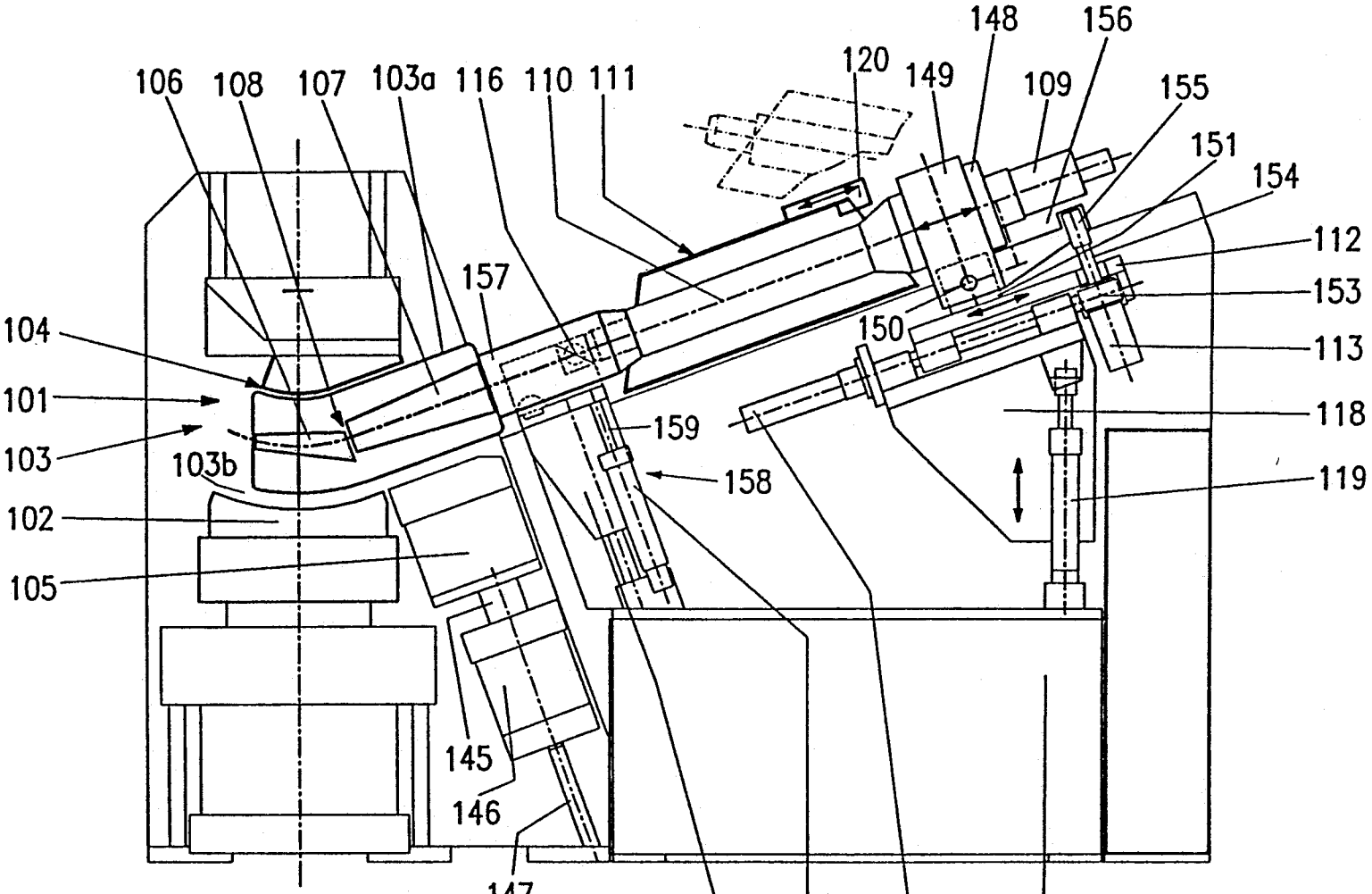
FIG. 4 is a schematic side view of a second embodiment of a device for manufacturing a pipe bend, in the starting position.
Figure 5:
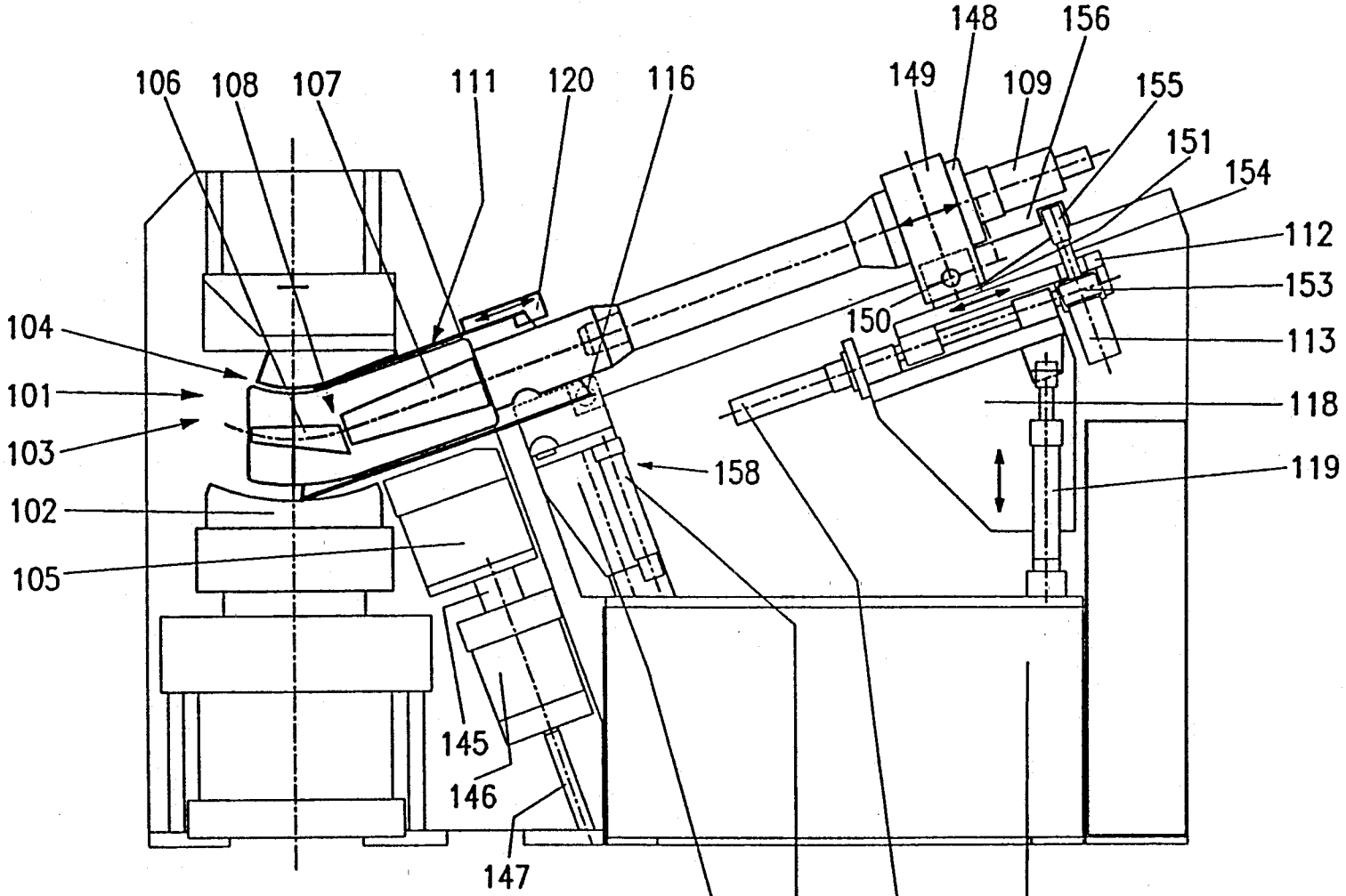
FIG. 5 shows the device of FIG. 4 in a working position.

A second embodiment of the described device is shown in FIGS. 4 and 5. This embodiment too comprises a shaping station 101 which is provided with upsetting and calibrating chops 102. A reciprocating guiding and transporting device 103 and an interspace 104 for taking up the pipe piece 111 to be worked are provided between these upsetting and calibrating chops 102. Said reciprocating guiding and transporting device 103 comprises a section **103*a*, the shape of which essentially corresponds to the inner shape of the finished pipe bend, and a straight section 103*b* the direction of which is opposite to the conveying direction. Again, cone-shaped bodies 106 and 107 are provided for expanding and compressing the segments of the transporting device 103. These cone-shaped bodies 106 and 107 are articulatedly linked to each other at 108 and are linked to a hydraulic actuating device 109**.

A support 105 is directed towards the straight section **103*b* which extends out of the upsetting and calibrating chops 102. This support 105 can be pressed against this straight section 103*b* of the reciprocating guiding and transporting device 103 by means of the piston rod 145 of a hydraulic cylinder 146. The pipe piece 111 to be bent, which is introduced in a manner described later into the interspace 104 between the upsetting and calibrating chops 102, is for the moment bent at its front end to the predetermined curvature. Thereafter, the support 105 is made to exert pressure onto the straight portion of pipe piece 111, which is placed in the section 103*b* of the reciprocating guiding and transporting device 103, so as to press the straight pipe section upwardly for complementing the pipe curvature. In other words, the bend being produced is the continuation of the curvature produced by the upsetting and calibrating chops 102. The support 105 and the hydraulic cylinder 146 are guided and mounted by and to, respectively, the machine frame 147**.

A loading device 110 serves the taking up of the pipe piece 111 to be worked, which at the beginning is straight and is bevelled at its ends. Said loading device 110 has a reinforced end section 149 at its end opposite to the conveying direction, and is hinged about an arbor 150 in a slide 151. The cylindrical end section 148 is provided with a hydraulic actuating device 109 cooperating with the cone-shaped bodies 106 and 107 for expanding and compressing the segments and being able to provoke a swiveling motion for closing and opening a bajonet joint.

The slide 151 is mounted on a movable carriage 112 which is reciprocatingly movable in the axial direction. Said carriage 112 is moved by a hydraulically actuated advance cylinder 117 mounted, together with the carriage 112, on a slide 118 which is vertically liftable and lowerable. The reciprocating motion of the carriage 112 effects both the advance of the pipe piece 111 to be worked and the disengaging of the loading device 110 for the loading proceeding. The said vertical displacement of the slide 118, in view of the adjustment of height, is effected by means of a hydraulic lifting device 119 supported by a frame 152.

The swiveling of the loading device 110 into the position shown by dash-dot lines in FIG. 4 is effected by means of a hydraulic cylinder 113 swivelably running at 153, the piston rod 154 of which is likewise swivelably linked at 155 with a mounting 156 of the loading device 110. For swiveling the loading device 110, its link with the front section 157 of the reciprocating guiding and transporting device 103 is to be loosened. This link is made by a turn-lock catch having the form of a bajonet joint and being arranged in the loading device 110. By a rotation motion generated by the hydraulic actuating device 109, the turn-lock catch can be loosened. Then, by retracting the piston rod 154, the loading device 110 t with the hydraulic actuating device 109 can be swiveled a the arbor 150 from the position traced in full in FIG. 4 to the position traced, in fragmentary form, in dash-dot lines. In this latter position, the pipe piece 111 to be worked can be fed by the schematically shown loading device 110. Care is to be taken that the reciprocating guiding and transporting device 103 is supported at its free end. For this purpose, the device comprises a hydraulic lifting and holding device 158 which in turn comprises a hydraulic cylinder 115, a piston rod 159 and tongue-shaped locking members 116 arranged on its sides. Said hydraulic lifting and holding device 158 is mounted on a movable carriage 114 which can be slantwise lifted. By displacing said movable carriage 114, by means of said hydraulic lifting and holding device 158 and by hydraulically actuating said tongue-shaped locking members 116, the reciprocating guiding and transporting device 103 is kept in an exactly defined position.

Otherwise the feeding of the pipe pieces 111 to the shaping station 101 is effected in the same manner as described for the first embodiment. Here too, after each upsetting and calibrating proceeding, the section of the pipe piece 111 which projects from the shaping station 101 and is not yet bent is subject to pressure in the direction of the curvature of the bending to be produced. This pressure is maintained until the retrograde motion of the reciprocating guiding and transporting device 103 is effected.

Thus, as described, the manufacture of a pipe bend from a straight pipe piece 111 is essentially effected by the following steps:

1. The loaded straight pipe piece 111 is conveyed to the shaping station 101 while the segments of the reciprocating guiding and transporting device 103 are expanded.
2. The upsetting and calibrating chops 102, which act as external tools, are closed, and the end of the pipe piece 111 is bent.
3. Pressure is applied to the pipe piece 111 by an upward motion of the support 105, in order to catch and counter a turn of the still straight pipe section which is opposite to the bending proceeding.
4. The support 105 is pulled back. During this pull-back motion, the segments of the reciprocating guiding and transporting device 103 return to their collapsed position. Thereafter, the guiding and transporting device 103 is pulled back as well.
5. The segments expand and grasp the pipe piece 111, so that it is moved farther into the shaping station 101 during the forward motion of the reciprocating guiding and transporting device 103 after the upsetting and calibrating chops 102, which act from the outside and temporarily clasp the pipe piece 111, were pulled back from the working position into the open position. This phase is shown in FIG. 5.
6. The steps 1 to 5 are repeated until the whole pipe piece 111 is bent.
7. For loading a new pipe piece, the bajonet joint between the front section 157 of the reciprocating guiding and transporting device 103 and the loading device 110 is loosened, the axial carriage 112 is pulled back, and the loading device 110 is swiveled about the arbor 150 by actuation of the hydraulic cylinder 113 and drawing back the piston rod 154.
8. A straight pipe piece 111 is loaded by means of the pipe loading device 120, and the loading device 110 is swiveled back to its starting position.

It is worth mentioning that by the vertical motion of the slide 118 and the axial motion of the slide 112, the devices 103, 109 and 110 which are mounted on them can be positioned in such a manner that they have the most favourable position for bending the pipe piece 111 during the bending proceeding.

The device described above is of a very simple construction and works most reliably. If desired, the proceedings can be fully automatized.

What is claimed is:

1. A device for manufacturing a pipe bend from a straight pipe piece having a round cross section, said device comprising:

an upsetting and calibrating unit defining a shaping station, said upsetting and calibrating unit comprising upsetting and calibrating chops which are jointly radially movable under the action of a force;

first actuatable means for, when actuated, providing a force to jointly radially move said upsetting and calibrating chops;

a reciprocating guiding and transporting device associated with said shaping station and extending into the same, said reciprocating guiding and transporting device comprising expandable and compressible grasping and supporting members; and means for effecting expansion and compression of said grasping and supporting members to (i) stepwise introduce said pipe piece to be formed into said shaping station, (ii) stepwise transport said pipe piece through said shaping station, and (iii) support inside of said pipe piece during the bending process.

2. A method for manufacturing a pipe bend from a straight pipe piece by means of actuating members acting on the outside of said pipe piece and defining an open shaping station, an outer dimension of said actuating members being expandable and compressible under the action of force, said method comprising the steps of:

stepwise moving said pipe piece to and through said shaping station by expanding a reciprocating member to grasp and pull said pipe piece during its move to said shaping station by means of said reciprocating member during the progressive motion of said reciprocating member;

introducing the leading end of said pipe piece into said shaping station by said reciprocating member;

supporting said pipe piece on its inside in said shaping station by said reciprocating member;

upsetting and calibrating said pipe piece by compressing said actuating members of said shaping station on said pipe piece while maintaining said supporting of said pipe piece on its inside;

collapsing said reciprocating member from said pipe piece;

retracting said reciprocating member from said shaping station while retaining said pipe piece in said shaping station during the retrograde motion of said reciprocating member; and repeating these steps until said pipe piece has completely passed through said shaping station.

3. The method of claim 2 further including the step of maintaining said actuating members of said shaping station expandedly open during the progressive motion of said reciprocating member, and further including the step of maintaining said actuating members, which previously were compressed for shaping, compressedly closed for retaining said pipe piece during the retrograde motion of said reciprocating member.

4. The method of claim 3 further including the step of increasing the outer dimension of said reciprocating member by expansion for internally grasping and supporting the section of said pipe piece to be bent.

5. The method of claim 4 further including the step of applying a force after each upsetting and calibrating cycle to the not yet formed section of said pipe piece extending outside said shaping station to subject the not yet formed section of said pipe piece to a bending load in the direction of the intended pipe bend.

6. The method of claim 5 wherein the step of applying a force to the not yet formed section of said pipe piece is maintained up to the retrograde motion of said reciprocating member.

7. A device for manufacturing a pipe bend from a straight pipe piece, said device comprising:

an upsetting and calibrating unit defining a shaping station, said upsetting and calibrating unit comprising upsetting and calibrating chops which are jointly radially movable under the action of a force;

first actuatable means for, when actuated, providing a force to jointly radially move said upsetting and calibrating chops;

a reciprocating guiding and transporting device associated with said shaping station and extending into the same, said reciprocating guiding and transporting device comprising expandable and compressible grasping and supporting members;

means for effecting expansion and compression of said grasping and supporting members to (i) stepwise introduce said pipe piece to be formed into said shaping station, (ii) stepwise transport said pipe piece through said shaping station, and (iii) support inside of said pipe piece during the bending process; and said reciprocating guiding and transporting device including an end having an outside which is curved in correspondence with said pipe piece to be formed, the outside of the end of said reciprocating guiding and transporting device being at least partially composed of segments radially arranged side by side, said segments being compressible and expandable for varying the effective outer dimension of said reciprocating guiding and transporting device.

8. The device of claim 7 wherein said reciprocating guiding and transporting deice is associated with a hydraulic actuating device coupled with two cone-shaped bodies which are arranged in said reciprocating guiding and transporting device and reciprocate to expand and compress the segments of the same.

9. The device of claim 8 wherein said hydraulic actuating device is arranged, at the end which is averse from said reciprocating guiding and transporting device, on a loading device.

10. The device of claim 9 wherein said loading device, said hydraulic actuating device, and said reciprocating guiding and transporting device form a unit which is inclined towards said shaping station.

11. The device of claim 10 wherein said loading device includes a free end supported by a support which can be swiveled away relative to said free end of said loading device, and wherein said reciprocating guiding and transporting device includes a starting end supported by a supporting arm which likewise can be swiveled away relative to said starting end of said reciprocating guiding and transporting device.

12. The device of claim 11 further comprising a pistoncylinder unit for swiveling said support into a home position in which said support supports said free end of said loading device, and another piston-cylinder unit for swiveling said supporting arm into a home position in which said supporting arm supports said starting end of said reciprocating guiding and transporting device.

13. The device of claim 8 wherein a suspension arrangement is glidably and swivelably arranged above said hydraulic actuating device in a guiding cam of a guiding piece, said suspension arrangement being provided with a holding unit which is reciprocatingly movable with respect to an actuating member and is detachably linked to said hydraulic actuating device.

14. The device of claim 13 further comprising a pistoncylinder unit for moving said holding unit.

15. The device of claim 13 further comprising an advance cylinder linked to said suspension arrangement for reciprocatingly moving said holding unit.

16. The device of claim 13 wherein a stopper is arranged on said glidable and swivelable suspension arrangement, said stopper projecting in one position of said suspension arrangement into the motion path of said pipe piece towards said shaping station.

17. The device of claim 8 further comprising:

a loading device for receiving said pipe piece to be worked, said loading device being coupled with a hydraulic actuating device effecting the actuation of said cone-shaped bodies; and a reciprocally movable carriage for transporting said pipe piece, said reciprocally movable carriage swivelably and lockably supporting said loading device and said hydraulic actuating device.

18. The device of claim 17 further comprising driving means arranged together with said movable carriage for moving said movable carriage on a liftable and lowerable slide.

19. The device of claim 17 wherein said loading device is swivelably mounted on a slide of said movable carriage and can be swiveled by means of a hydraulic arrangement and is detachably linked with a front section of said reciprocating guiding and transporting device, which link is detached and locked by said hydraulic actuating device of said loading device.

20. The device of claim 19 wherein said detachable link is a revolving locking.

21. The device of claim 19 wherein said front section of said reciprocating guiding and transporting device is by means of a lifting and holding device.

22. The device of claim 21 wherein said lifting and holding device is mounted on an upwardly movable carriage.

23. The device of claim 22 wherein said lifting and holding device compresses lateral tongue-shaped locking members by means of which said reciprocating guiding and transporting device, which is positioned by the displacement of said movable carriage, can be locked.

24. A device for manufacturing a pipe bend from a straight pipe piece, said device comprising:

an upsetting and calibrating unit defining a shaping station, said upsetting and calibrating unit comprising upsetting and calibrating chops which are jointly radially movable under the action of a force;

first actuatable means for, when actuated, providing a force to jointly radially move said upsetting and calibrating chops;

a reciprocating guiding and transporting device associated with said shaping station and extending into the same, said reciprocating guiding and transporting device comprising expandable and compressible grasping and supporting members;

means for effecting expansion and compression of said grasping and supporting members to (i) stepwise introduce said pipe piece to be formed into said shaping station, (ii) stepwise transport said pipe piece through said shaping station, and (iii) support inside of said pipe piece during the bending process; and a support directed toward a portion of said pipe piece to be worked which extends out of the calibrating chops, said support being designated for applying, under the pressure of a hydraulic arrangement, a bending load to the pipe piece locked by said upsetting and calibrating chops.

25. The device of claim 24 wherein said hydraulic arrangement comprises a hydraulic cylinder and a piston which is turn comprises a piston rod directed towards said support.

* * * * *

UNITED STATES PATENT AND TRADEMARK OFFICE

CERTIFICATE OF CORRECTION

PATENT NO. : 5,257,524

DATED : November 2, 1993

INVENTOR(S) : Werner Jung

It is certified that error appears in the above-identified patent and that said Letters Patent is hereby corrected as shown below:

Column 10, lines 3-4, change "pistoncylinder" to --piston-cylinder--.

Column 10, lines 17-18, change "pistoncylinder" to --piston-cylinder--.

Column 10, line 51, after "is" insert --detachably supported at its end which faces said loading device--.

Column 12, line 5, change "designated" to --destinated--.

Signed and Sealed this

Thirty-first Day of May, 1994

Bruce Lehman

*Attest:*

BRUCE LEHMAN

*Attesting Officer*

*Commissioner of Patents and Trademarks*